US008794027B2

(12) United States Patent
Gotou et al.

(10) Patent No.: US 8,794,027 B2
(45) Date of Patent: Aug. 5, 2014

(54) COMPRESSOR AND REFRIGERATING APPARATUS

(75) Inventors: Nozomi Gotou, Sakai (JP); Harunori Miyamura, Sakai (JP); Hideyuki Gotou, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1220 days.

(21) Appl. No.: 12/663,908

(22) PCT Filed: Jun. 11, 2008

(86) PCT No.: PCT/JP2008/060688

§ 371 (c)(1),
(2), (4) Date: Dec. 10, 2009

(87) PCT Pub. No.: WO2008/153061

PCT Pub. Date: Dec. 18, 2008

(65) Prior Publication Data

US 2010/0229595 A1 Sep. 16, 2010

(30) Foreign Application Priority Data

Jun. 11, 2007 (JP) ..... 2007-153857
Jun. 9, 2008 (JP) ..... 2008-150617

(51) Int. Cl.
*F25B 31/00* (2006.01)
*F04B 49/16* (2006.01)
*F04B 49/20* (2006.01)

(52) U.S. Cl.
USPC ..... 62/505; 417/44.1; 417/212; 417/310

(58) Field of Classification Search
USPC ..... 62/505
See application file for complete search history.

(56) References Cited

U.S. PATENT DOCUMENTS 3,913,346 A * 10/1975 Moody et al. ..... 62/197
3,931,718 A * 1/1976 Haselden ..... 62/505
4,020,642 A * 5/1977 Haselden et al. ..... 62/84
4,216,661 A * 8/1980 Tojo et al. ..... 62/505
RE30,499 E * 2/1981 Moody et al. ..... 62/117
4,364,714 A 12/1982 Zimmern
5,103,652 A * 4/1992 Mizuno et al. ..... 62/505
5,329,788 A * 7/1994 Caillat et al. ..... 62/505

(Continued)

FOREIGN PATENT DOCUMENTS

JP 48-66209 A 9/1973
JP 53-97710 U 8/1978

(Continued)

*Primary Examiner* — Ljiljana Ciric
*Assistant Examiner* — Alexis Cox
(74) *Attorney, Agent, or Firm* — Global IP Counselors

(57) ABSTRACT

A compressor includes a casing, a screw rotor, a slide member with at least one economizer port, and a control unit controlling a position of the slide member along the axis of the screw rotor to position the at least one economizer port based on the rotating speed of the screw rotor to advance the timing of opening of the at least one economizer port. The controller controls the position of the slide member along the axis such that the slide member moves upstream toward a suction side of the compressor when the rotating speed of the screw rotor increases, and downstream toward a discharge side of the compressor when the rotating speed of the screw rotor decreases. A refrigerating apparatus includes the compressor, a condenser, a heat exchanger, an expansion unit, and an evaporator, sequentially connected, and has an economizer line.

2 Claims, 13 Drawing Sheets

(56) References Cited

U.S. PATENT DOCUMENTS

| | | | | |
|---|---|---|---|---|
| 5,722,257 | A * | 3/1998 | Ishii et al. | 62/505 |
| 6,182,467 | B1 * | 2/2001 | Zhong et al. | 62/470 |
| 6,430,959 | B1 * | 8/2002 | Lifson | 62/505 |
| 6,755,039 | B2 * | 6/2004 | Tsuboi | 62/197 |
| 8,516,850 | B2 * | 8/2013 | Jadric et al. | 62/505 |
| 2006/0039805 | A1 * | 2/2006 | Gotou et al. | 417/410.4 |
| 2006/0285966 | A1 | 12/2006 | Gotoh et al. | |
| 2008/0184733 | A1 * | 8/2008 | Skinner | 62/505 |

FOREIGN PATENT DOCUMENTS

| | | | |
|---|---|---|---|
| JP | 56-2490 | A | 1/1981 |
| JP | 57-32369 | U | 2/1982 |
| JP | 57-38692 | A | 3/1982 |
| JP | 60-164693 | A | 8/1985 |
| JP | 61-272486 | A | 12/1986 |
| JP | 63-9490 | U | 1/1988 |
| JP | 2005-83260 | A | 3/2005 |

* cited by examiner

COMPRESSOR AND REFRIGERATING APPARATUS

CROSS-REFERENCE TO RELATED APPLICATIONS

This U.S. National stage application claims priority under 35 U.S.C. §119(a) to Japanese Patent Application Nos. 2007-153857, filed in Japan on Jun. 11, 2007, and 2008-150617, filed in Japan on Jun. 9, 2008, the entire contents of which are hereby incorporated herein by reference.

TECHNICAL FIELD

The present invention relates to a compressor and a refrigerating apparatus.

BACKGROUND ART

A conventional compressor includes a screw rotor and a cylinder having economizer ports, which are made to communicate with compression chambers between the screw rotor and the cylinder before the compression chambers are completely closed (see JP 2005-83260 A).

SUMMARY OF INVENTION

Technical Problem

In the conventional compressor, however, timing of opening of the economizer ports, that is, positions of the economizer ports are fixed regardless of rotating speed of the screw rotor, and thus a problem has been caused in that it is impossible to maximally utilize effects of the economizer because difficulty in increasing a quantity of suction of refrigerant from the economizer ports results in reduction in cooling effect obtained from the refrigerant, depending upon the rotating speed of the screw rotor.

It is a primary object of the invention to provide a compressor that is capable of maximally utilizing the effects of the economizer regardless of the rotating speed of the screw rotor.

Solution to Problem

In order to solve the above problem, a compressor in accordance with one aspect of the invention comprises:

a casing, a screw rotor fitted in the casing, at least one economizer port for discharging refrigerant into compression chambers formed between the casing and the screw rotor, and a control unit that advances timing of opening of the at least one economizer port to the compression chambers in accordance with increase in rotating speed of the screw rotor.

With such a compressor, which has the control unit that advances the timing of opening of the at least one economizer port to the compression chambers with increase in the rotating speed of the screw rotor, the economizer ports are opened earlier than complete closure of the compression chambers (complete closure of grooves of the screw rotor) in high speed operation of the screw rotor, while the economizer ports are opened with delay in low speed operation of the screw rotor.

Therefore, a quantity of suction of the refrigerant from the at least one economizer port to the compression chambers can be increased while the refrigerant discharged from the economizer ports into the compression chambers is prevented from leaking to low-pressure side of the screw rotor.

Thus, increase in the quantity of suction of the refrigerant from the at least one economizer port, increase in cooling effect obtained from the refrigerant, and maximal utilization of the effects of the economizer can be attained regardless of the rotating speed of the screw rotor.

In accordance with one aspect of the present invention, the control unit shifts positions of the at least one economizer port along an axis of the screw rotor in accordance with the rotating speed of the screw rotor.

With a compressor in accordance with this aspect, the timing of opening of the at least one economizer port can easily be controlled because the control unit shifts the positions of the economizer ports along the axis of the screw rotor in accordance with the rotating speed of the screw rotor.

In accordance with one aspect of the present invention, the compressor further comprises:

a slide member placed between the casing and the screw rotor, provided with the at least one economizer port, and being movable along the axis of the screw rotor, wherein the control unit shifts the slide member along the axis of the screw rotor in accordance with the rotating speed of the screw rotor.

With a compressor in accordance with this aspect, the timing of opening of the at least one economizer port can easily be controlled by a simple configuration because the control unit shifts the slide member, provided with the economizer ports, along the axis of the screw rotor in accordance with the rotating speed of the screw rotor.

In accordance with one aspect of the present invention, a plurality of the economizer ports are placed along an axis of the screw rotor, and wherein the control unit selectively opens the plurality of economizer ports in accordance with the rotating speed of the screw rotor.

With a compressor in accordance with this aspect, the timing of opening of the at least one economizer port can easily be controlled because the control unit selectively opens the plurality of economizer ports in accordance with the rotating speed of the screw rotor.

A refrigerating apparatus in accordance with another aspect of the invention comprises:

a compressor in accordance with any of the above aspects, a condenser, a heat exchanger for supercooling, an expansion unit, and an evaporator, wherein the compressor, the condenser, the heat exchanger for supercooling, the expansion unit, and the evaporator are sequentially connected to each other through a circulating circuit, and wherein the heat exchanger for supercooling and the at least one economizer port of the compressor are connected to each other by an economizer line.

With a refrigerating apparatus in accordance with this aspect, which has a compressor in accordance with any of the above aspects, the effects of the economizer can maximally be utilized for the compressor, so that an efficient refrigerating apparatus can be obtained.

Advantageous Effects of Invention

With a compressor, which has the control unit that advances the timing of opening of the at least one economizer port to the compression chambers with increase in the rotating speed of the screw rotor, the effects of the economizer can maximally be utilized regardless of the rotating speed of the screw rotor.

With a refrigerating apparatus, which has such a compressor, the effects of the economizer can maximally be utilized for the compressor, so that an efficient refrigerating apparatus can be obtained.

DESCRIPTION OF EMBODIMENTS

Figure 1:
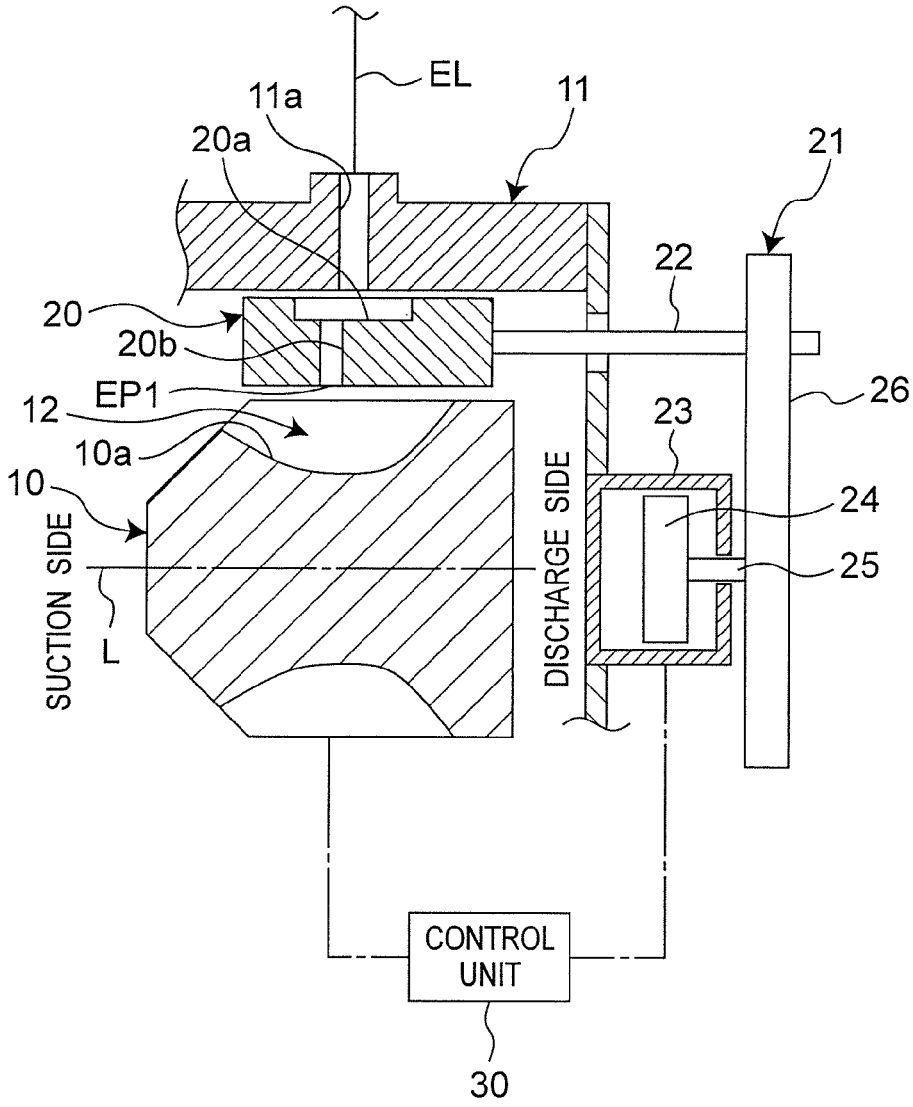
FIG. 1 is a schematic configuration showing a first embodiment of a compressor of the invention.

Hereinbelow, the invention will be described in detail with reference to embodiments shown in the drawings.

First Embodiment

Figure 2:
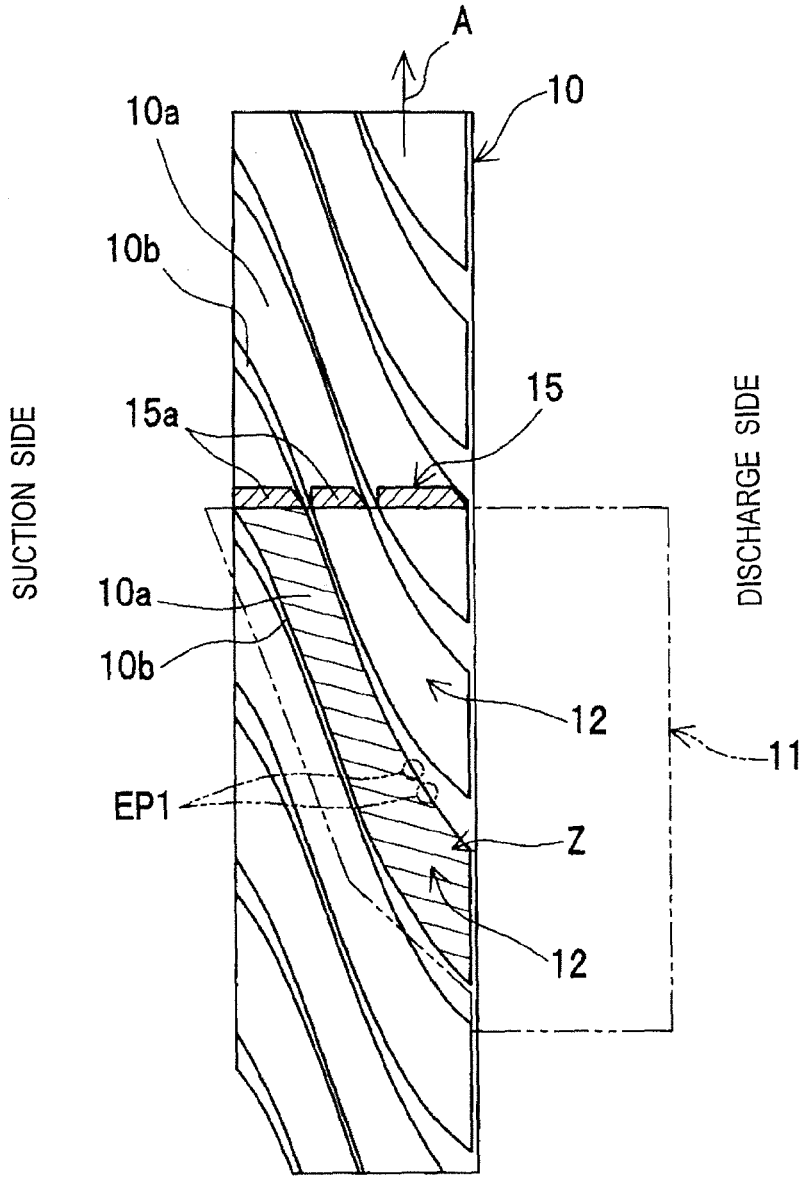
FIG. 2 is a schematic development plan of the compressor on condition that a speed of a screw rotor is low.

FIG. 1 shows a schematic configuration of a first embodiment of a compressor of the invention. FIG. 2 shows a schematic development plan of the compressor. As shown in FIGS. 1 and 2, the compressor has a casing 11 and a screw rotor 10 fitted in the casing 11.

A pair of gate rotors 15 are placed on both sides of the screw rotor 10 with respect to an axis L thereof. The gate rotors 15 mesh with the screw rotor 1, and the mesh between the screw rotor 10 and the gate rotors 15 forms compression chambers 12. That is, the compressor is a so-called single screw compressor.

The screw rotor 10 has a plurality of helical vanes 10*b* and screw grooves 10*a* between adjacent vanes 10*b*, 10*b*. The gate rotors 15 each have a plurality of teeth 15*a*. The screw grooves 10*a* and the teeth 15*a* mesh with each other, so that the screw grooves 10*a*, the teeth 15*a* and the casing 11 define the compression chambers 12.

The screw rotor 10 rotates in a direction of an arrow A in FIG. 2 and thereby delivers refrigerant, sucked from suction side of the screw rotor 10, to discharge side of the screw rotor 10 while compressing the refrigerant in the compression chambers 12. In FIGS. 1 and 2, left side on planes thereof corresponds to the suction side for the refrigerant and right side on the planes corresponds to the discharge side for the refrigerant.

In the compressor are provided economizer ports EP1 for discharge of the refrigerant into the compression chambers 12 formed between the casing 11 and the screw rotor 10. There are provided two economizer ports EP1, which are arranged along the vanes 10*b*.

The compressor has a control unit 30 that advances timing of opening of the economizer ports EP1 to the compression chambers 12 as the rotating speed of the screw rotor 10 increases. The screw rotor 10 is driven by an inverter.

The control unit 30 shifts opening positions of the economizer ports EP1 along the axis L of the screw rotor 10 in accordance with the rotating speed of the screw rotor 10.

Specifically, a slide member 20 that is movable along the axis L of the screw rotor 10 is placed between the casing 11 and the screw rotor 10.

The slide member 20 is moved by a drive unit 21 along the axis L of the screw rotor 10. The drive unit 21 has a slide rod 22 fixed to the slide member 20, a cylinder fixed to the casing 11, a piston 24 fitted in the cylinder 23, a piston rod 25 fixed to the piston 24, and a connecting member 26 for connecting the slide rod 22 and the piston rod 25.

Thus, the slide member 20 is reciprocated along the axis L of the screw rotor 10 by reciprocation of the piston 24 in the cylinder 23.

The slide member 20 has a groove 20*a*, which extends along the axis L of the screw rotor 10, on a surface thereof facing an inner surface of the casing 11. In the slide member 20 are provided bores 20*b* penetrating a surface thereof facing an outer surface of the screw rotor 10 and communicating with the groove 20*a*.

Openings of the bores 20*b* on a side of the screw rotor 10 correspond to the economizer ports EP1 provided on the slide member 20.

In the casing 11 is provided a through hole 11*a* connected to an economizer line EL. The economizer line EL, the through hole 11*a*, the groove 20*a*, and the bores 20*b* communicate with each other for discharge of refrigerant, which is provided from the economizer line EL, through the economizer ports EP1 into the compression chambers 12.

Even though the slide member 20 moves along the axis L of the screw rotor 10, the groove 20*a* that is formed so as to extend along the axis L of the screw rotor 10 allows the refrigerant from the economizer line EL to be made to flow without intermission through the through hole 11*a*, the groove 20*a*, and the bores 20*b*.

The control unit 30 controls the drive unit 21 to move the slide member 20 along the axis L of the screw rotor 10 in accordance with the rotating speed of the screw rotor 10.

On condition that the rotating speed of the screw rotor 10 is large, namely, the control unit 30 controls the drive unit 21 to move the slide member 20 to the suction side for the refrigerant so as to advance the timing of opening of the economizer ports EP1. On condition that the rotating speed of the screw rotor 10 is small, on the other hand, the control unit 30 controls the drive unit 21 to move the slide member 20 to the discharge side for the refrigerant so as to retard the timing of opening of the economizer ports EP1.

On condition that a rotating speed of the screw rotor 10 is low, as specifically shown in FIG. 2, the economizer ports EP1 are half-open to the compression chamber 12 at the instant of complete closure of the compression chamber 12 as shown by an area Z in FIG. 2.

Figure 3:
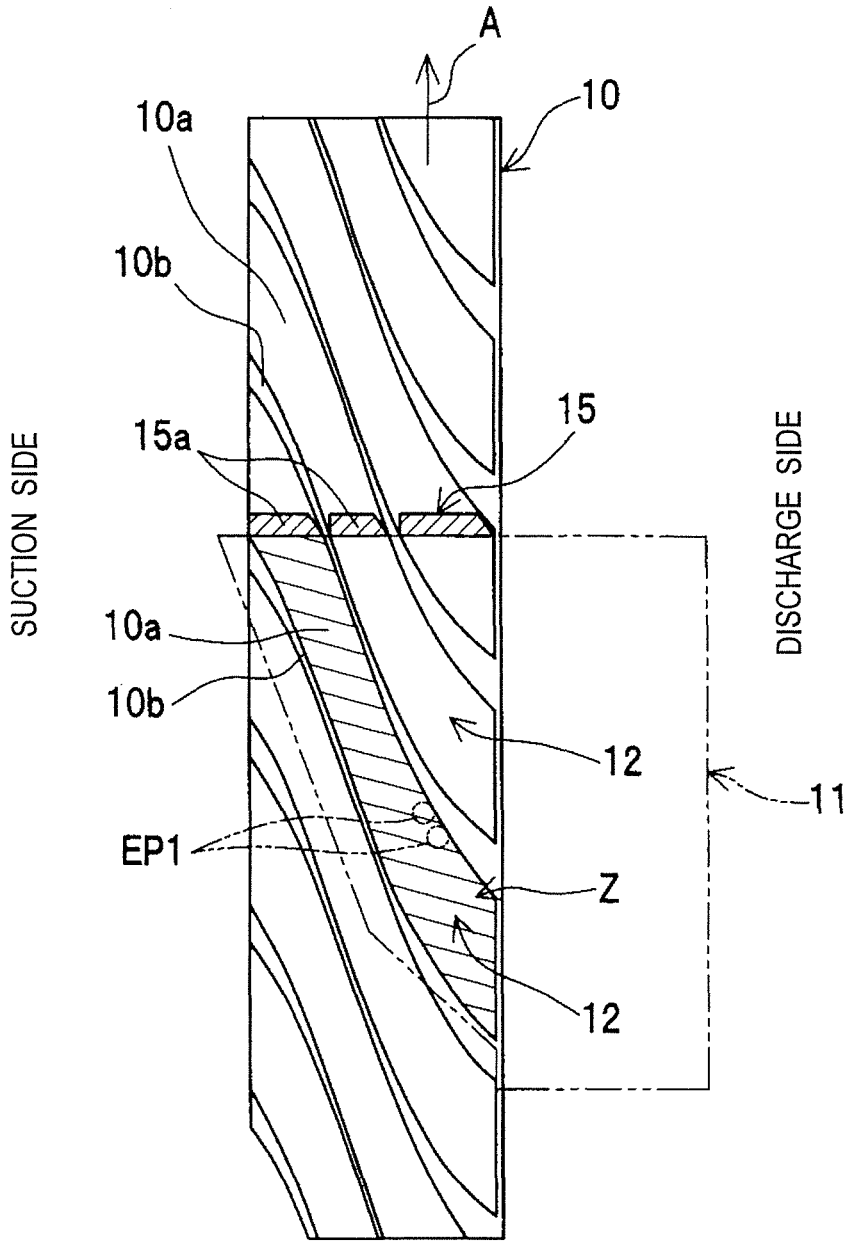
FIG. 3 is a schematic development plan of the compressor on condition that a speed of a screw rotor is medium.

On condition that the rotating speed of the screw rotor 10 is medium, as shown in FIG. 3, the economizer ports EP1 are completely open to the compression chamber 12 at the instant of complete closure of the compression chamber 12 as shown by an area Z in FIG. 3.

Figure 4:
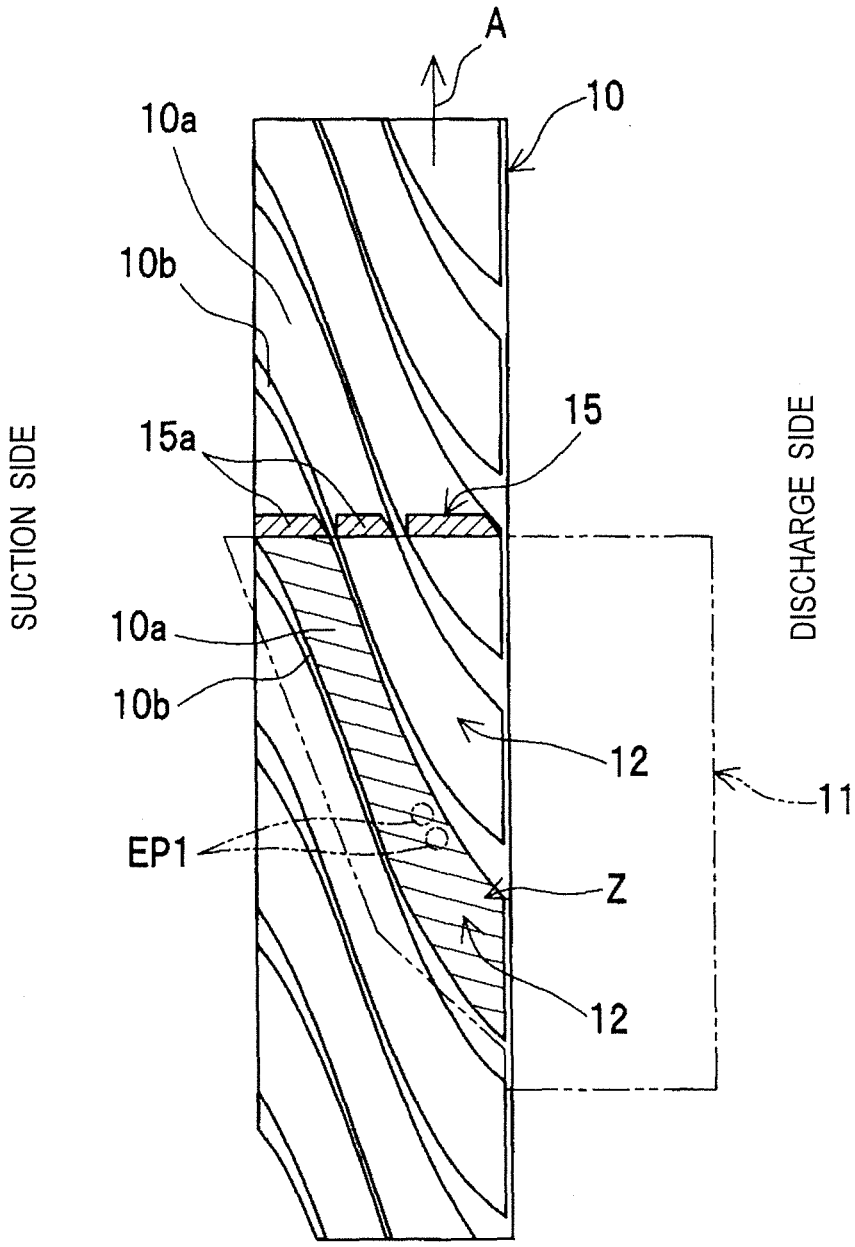
FIG. 4 is a schematic development plan of the compressor on condition that a speed of a screw rotor is high.

On condition that the rotating speed of the screw rotor 10 is high, as shown in FIG. 4, the economizer ports EP1 are completely open to the compression chamber 12 at the instant of complete closure of the compression chamber 12 as shown by an area Z in FIG. 4. In the high-speed operation, the economizer ports EP1 are earlier opened to the compression chamber 12 than in the medium speed operation of FIG. 3, i.e., are opened before the compression chamber 12 is completely closed.

Figure 5:
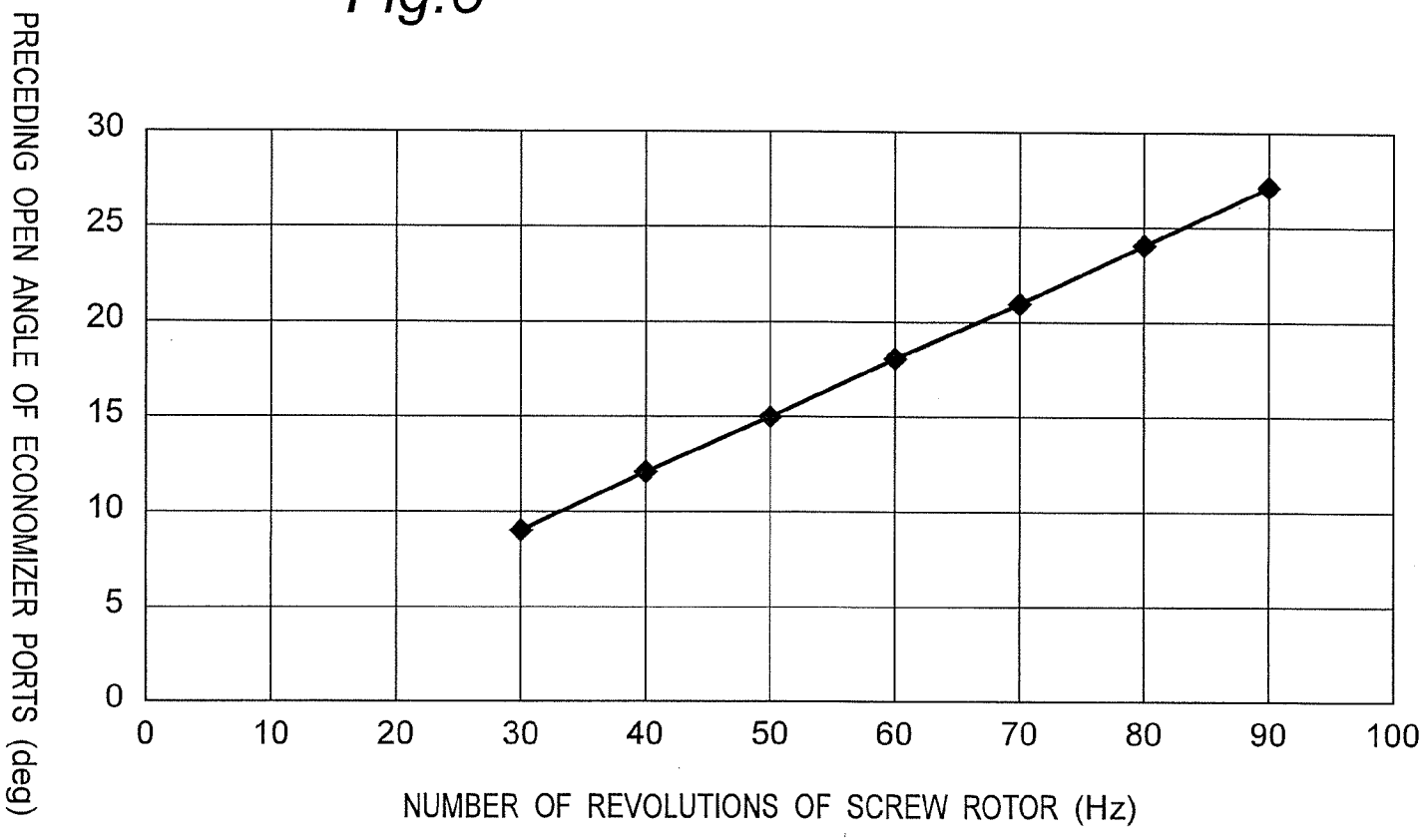
FIG. 5 is a graph showing timing of opening of economizer ports.

As shown in a graph of FIG. 5, in short, a preceding open angle of the economizer ports is increased in accordance with increase in the rotating speed of the screw rotor. Herein, the preceding open angle of the economizer ports refers to a rotation angle of the screw rotor in the moment that the economizer ports precedently begin to open into the compression chamber before closure of the compression chamber on condition that a rotation angle of the screw rotor is 0° at the instant of closure of the compression chamber.

In the compressor configured as above and having the control unit 30 that advances the timing of opening of the economizer ports EP1 to the compression chamber 12 in accordance with increase in the rotating speed of the screw rotor 10, the economizer ports EP1 are opened earlier than complete closure of the compression chamber 12 (complete closure of the screw groove 10*a* of the screw rotor 10) in the high-speed operation of the screw rotor 10, while the economizer ports EP1 are opened with delay in the low-speed operation of the screw rotor 10.

Therefore, a quantity of suction of the refrigerant from the economizer ports EP1 to the compression chambers 12 can be increased while the refrigerant discharged from the economizer ports EP1 into the compression chambers 12 is prevented from leaking to low-pressure side of the screw rotor 10.

Thus, increase in the quantity of suction of the refrigerant from the economizer ports EP1, increase in cooling effect obtained from the refrigerant, and maximal utilization of the effects of the economizer can be attained regardless of the rotating speed of the screw rotor 10.

In the high-speed rotation, namely, increase in the rotating speed of the screw rotor 10 in contrast to constant flow velocity of the refrigerant spouting from the economizer ports EP1 advances complete closure of the screw grooves 10*a* and provides a margin for the leak to the low-pressure side. In the high-speed operation, accordingly, the timing of opening of the economizer ports EP1 can be advanced.

In the low-speed rotation, on the other hand, the timing of opening of the economizer ports EP1 is required to be retarded in comparison with the high-speed rotation because the rotating speed of the screw rotor 10 lower than in the high-speed rotation might cause leak to the low-pressure side without advance of the complete closure.

In the compressor having the above configuration, the timing of opening of the economizer ports EP1 can easily be controlled because the control unit 30 shifts the positions of the economizer ports EP1 along the axis L of the screw rotor 10 in accordance with the rotating speed of the screw rotor 10.

Besides, the control unit 30 moves the slide member 20, which has the economizer ports EP1 provided therein, along the axis L of the screw rotor 10 in accordance with the rotating speed of the screw rotor 10, and thus the timing of opening of the economizer ports EP1 can easily be controlled with use of a simple configuration.

Second Embodiment

Figure 6A:
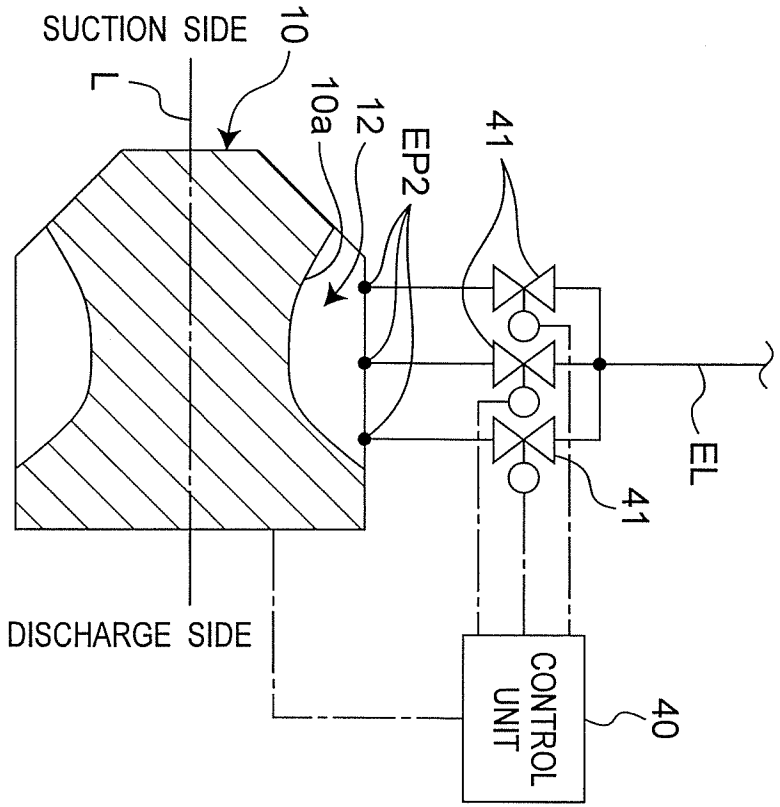
FIG. 6A is a schematic configuration showing a second embodiment of a compressor of the invention.

FIG. 6A shows a second embodiment of a compressor of the invention. From the first embodiment, the second embodiment is different in structure of the economizer ports. The other structures are the same as of the first embodiment, and therefore description thereof will be omitted.

As shown in FIG. 6A, a plurality of economizer ports EP2 are placed along an axis L of a screw rotor 10. A control unit 40 selectively opens the plurality of economizer ports EP2 in accordance with rotating speed of the screw rotor 10.

A solenoid valve 41 is provided on upstream side of each of the economizer ports EP2, and the control unit 40 selectively controls the solenoid valve 41 to selectively open the plurality of economizer ports EP2 in accordance with the rotating speed of the screw rotor 10.

That is, the control unit 40 opens the solenoid valves 41 nearer to discharge side to open the economizer ports EP2 nearer to the discharge side, with increase in the rotating speed of the screw rotor 10.

Figure 6B:
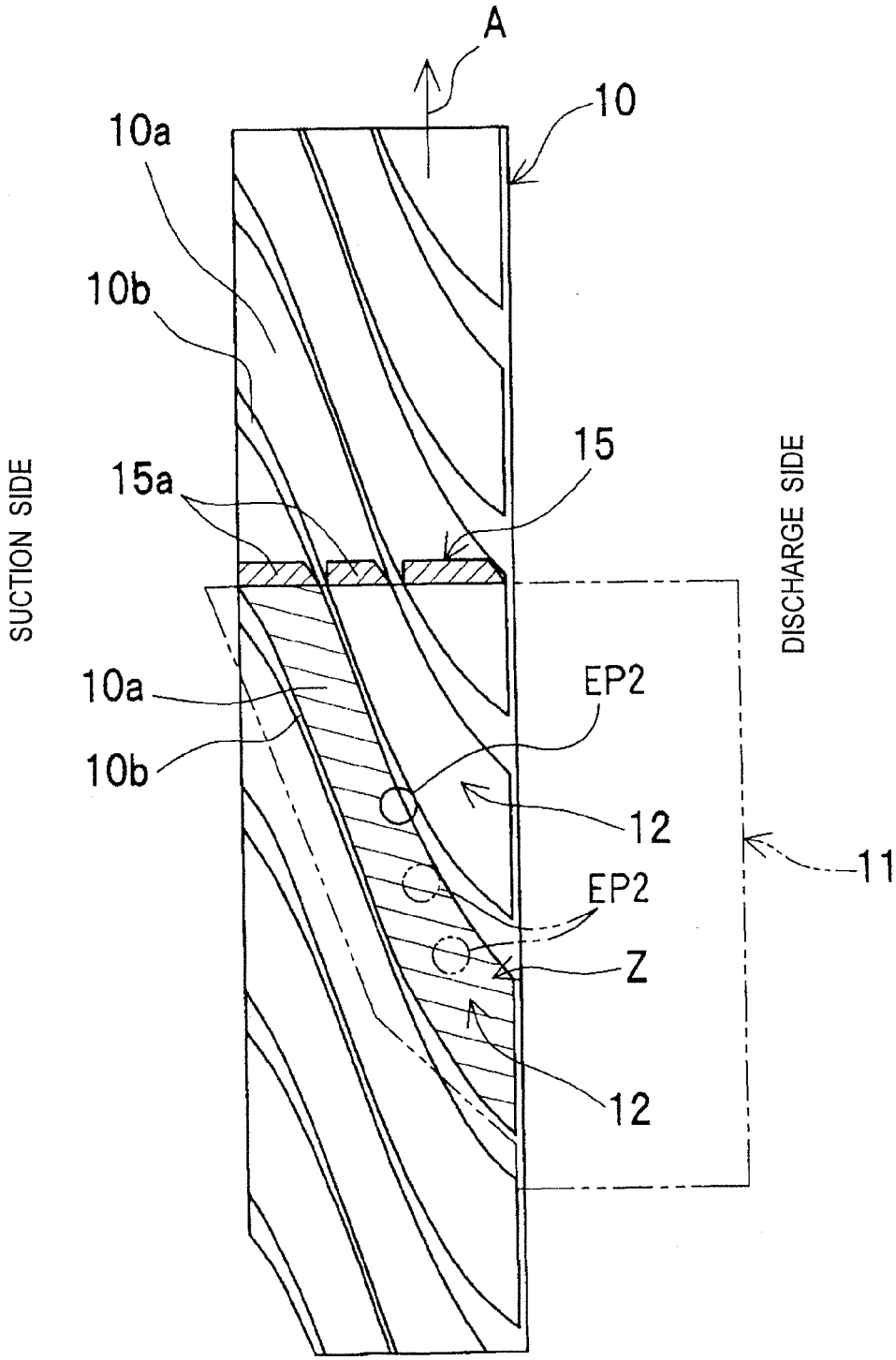
FIG. 6B is a schematic development plan of the compressor on condition that a speed of a screw rotor is low.

As shown in FIG. 6B, specifically, three economizer ports EP2 are arranged along a vane 10*b*. On condition that a rotating speed of the screw rotor 10 is low, only the economizer port EP2 that is the nearest to suction side (that is shown by a solid line) is opened. At the instant when the compression chamber 12 is completely closed as shown by an area Z in FIG. 6B, the economizer port EP2 (shown by the solid line) is half-open to the compression chamber 12.

Figure 6C:
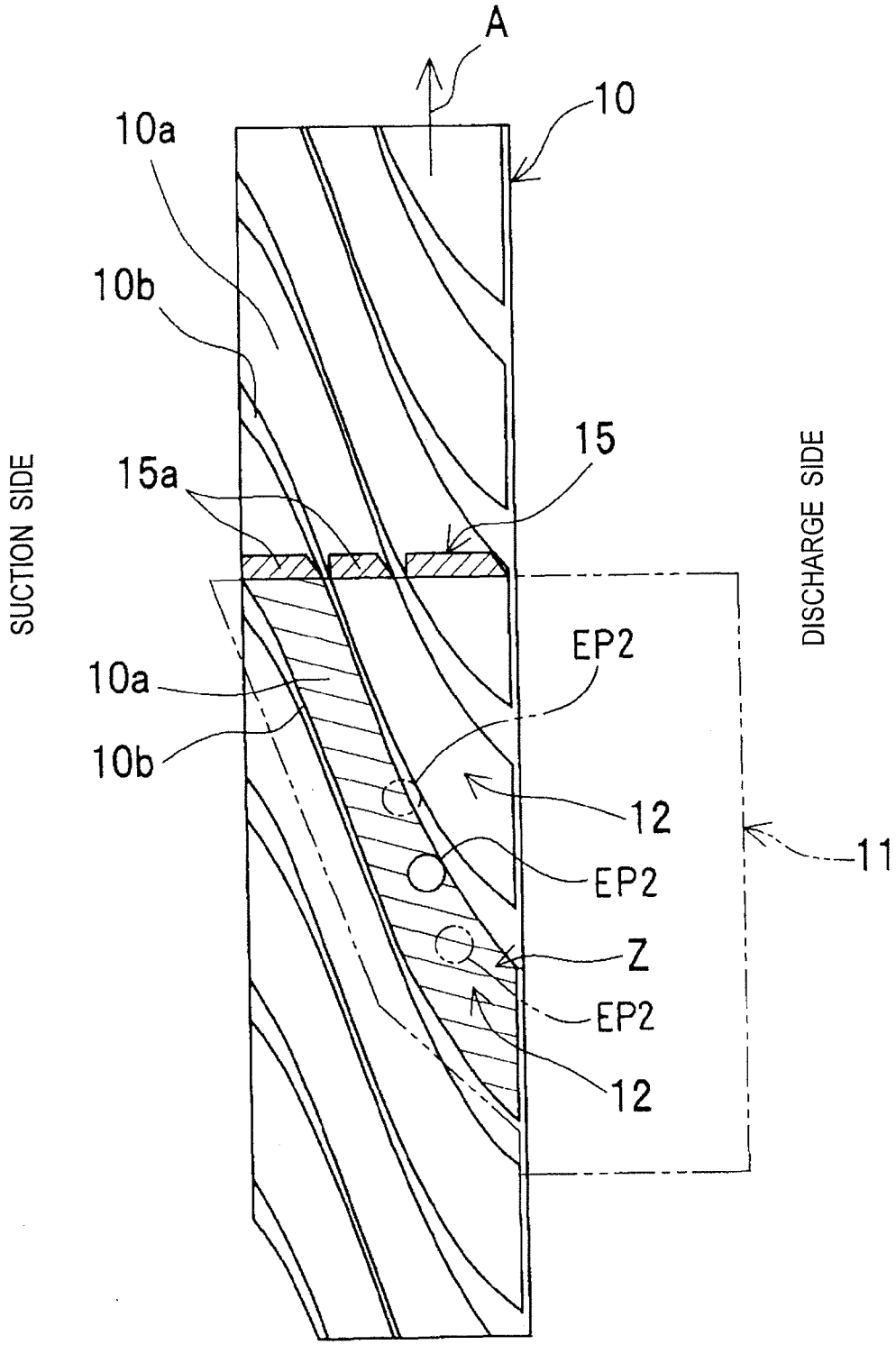
FIG. 6C is a schematic development plan of the compressor on condition that a speed of a screw rotor is medium.

On condition that the rotating speed of the screw rotor 10 is medium, as shown in FIG. 6C, only the economizer port EP2 that is at center (that is shown by a solid line) is opened. At the instant when the compression chamber 12 is completely closed as shown by an area Z in FIG. 6C, the economizer port EP2 (shown by the solid line) is completely open to the compression chamber 12.

Figure 6D:
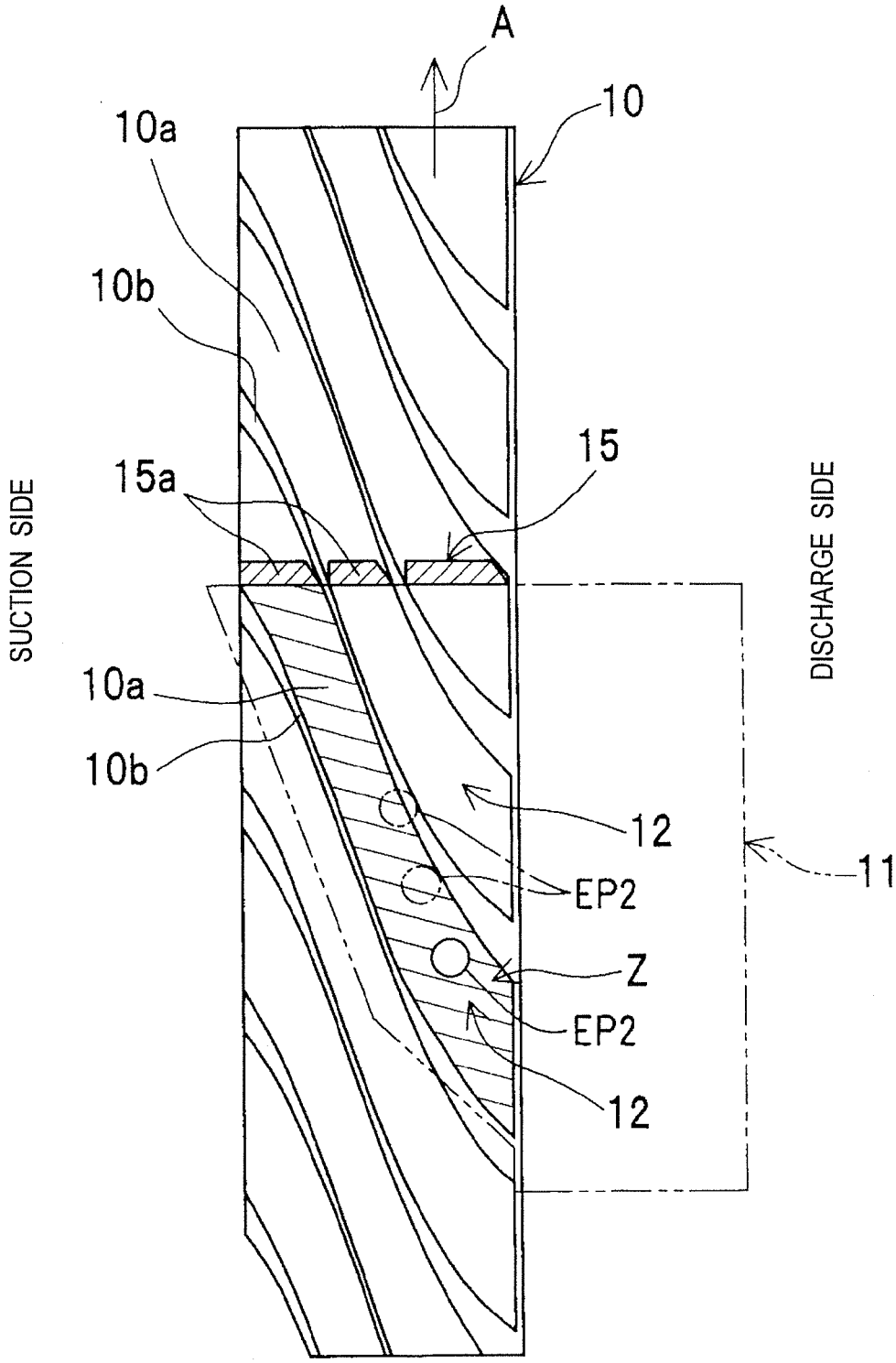
FIG. 6D is a schematic development plan of the compressor on condition that a speed of a screw rotor is high.

On condition that the rotating speed of the screw rotor 10 is high, as shown in FIG. 6D, only the economizer port EP2 that is the nearest to the discharge side (that is shown by a solid line) is opened. At the instant when the compression chamber 12 is completely closed as shown by an area Z in FIG. 6D, the economizer port EP2 (shown by the solid line) is completely open to the compression chamber 12. In the high-speed operation, the economizer port EP2 is earlier opened to the compression chamber 12 than in the medium-speed operation of FIG. 6C, i.e., is completely opened before the compression chamber 12 is completely closed.

Therefore, the control unit 40 selectively opens the plurality of economizer ports EP2 in accordance with the rotating speed of the screw rotor 10, so that the timing of opening of the economizer ports EP2 can easily be controlled.

Third Embodiment

Figure 7:
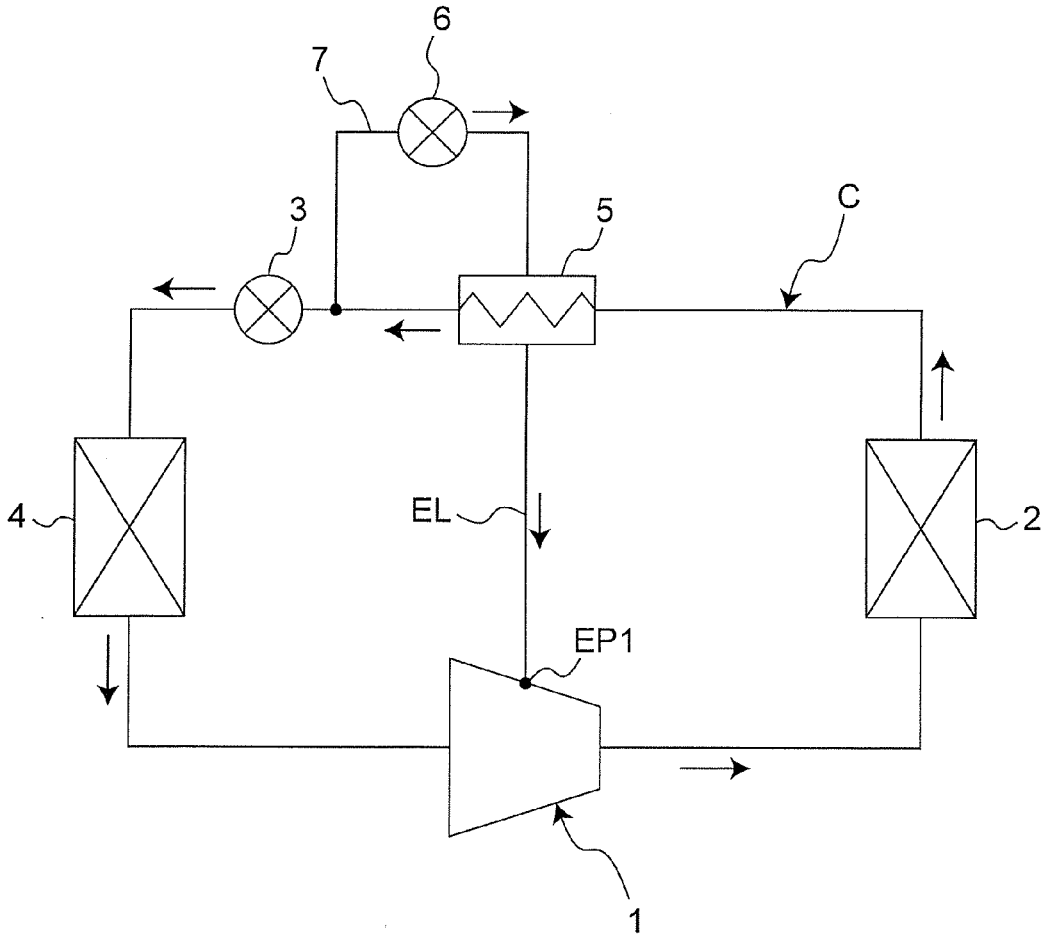
FIG. 7 is a schematic configuration showing an embodiment of a refrigerating apparatus of the invention.

In FIG. 7 is shown an embodiment of a refrigerating apparatus of the invention. The refrigerating apparatus of the invention has the compressor 1 of the first embodiment, a condenser 2, a heat exchanger 5 for supercooling, an expansion unit 3, and an evaporator 4.

The compressor 1, the condenser 2, the heat exchanger 5 for supercooling, the expansion unit 3, and the evaporator 4 are sequentially connected to each other through a circulating circuit C. The expansion unit 3 is an expansion valve, a capillary tube or the like, for example.

That is, the compressor 1, the condenser 2, the expansion unit 3, and the evaporator 4 form a refrigerating cycle. In the refrigerating cycle, refrigerant in vapor phase discharged from the compressor 1 is deprived of heat and changed into liquid phase in the condenser 2, and the refrigerant in liquid phase is decompressed by the expansion unit 3 so as to be in two-phase state of vapor and liquid. After that, the two-phase refrigerant (wet gas) is provided with heat and changed into vapor phase in the evaporator 4, and the refrigerant in vapor phase is sucked into and pressurized by the compressor 1, subsequently being discharged afresh from the compressor 1.

The heat exchanger 5 for supercooling and the economizer ports EP1 of the compressor 1 are connected to each other by the economizer line EL.

A branch passage 7 branching from between the heat exchanger 5 for supercooling and the expansion unit 3 in the circulating circuit C is connected to the heat exchanger 5 for supercooling, and an expansion unit 6 for supercooling is provided in the branch passage 7. An expansion valve, a capillary tube or the like, for example, is used as the expansion unit 6 for supercooling.

The heat exchanger 5 for supercooling performs heat exchange between refrigerant on exit side of the expansion unit 6 for supercooling and refrigerant in the circulating circuit C. The branch passage 7 may branch from the circulating circuit C on upstream side of the heat exchanger 5 for supercooling.

In a function of the heat exchanger 5 for supercooling, which will be described below, the refrigerant in liquid phase outgoing from the condenser 2 in the circulating circuit C is divided and directed into the branch passage 7. The refrigerant in liquid phase in the branch passage 7 is decompressed in the expansion unit for supercooling so as to become refrigerant in two phases of vapor and liquid, the refrigerant in the two phases deprives the liquid-phase refrigerant in the circulating circuit C of heat through the heat exchanger 5 for supercooling and become refrigerant in vapor phase, and the refrigerant in vapor phase flows through the economizer line EL so as to be sucked into the compressor 1 through the economizer ports EP1. On this occasion, the refrigerant in liquid phase in the circulating circuit C is cooled through the heat exchanger 5 for supercooling.

In the refrigerating apparatus with the above configuration, which has the compressor 1, the effects of the economizer can maximally be utilized for the compressor 1, so that an efficient refrigerating apparatus can be realized.

Fourth Embodiment

Figure 8A:
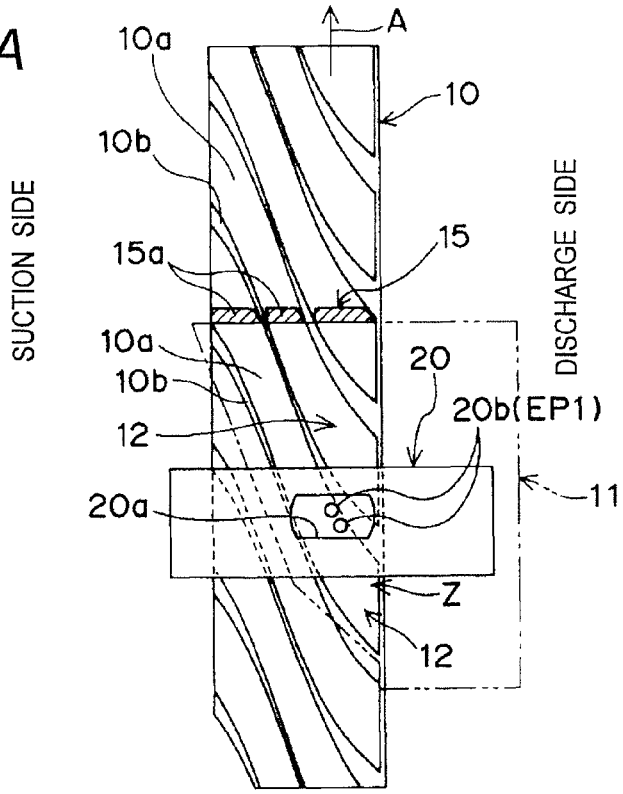
FIG. 8A is a plan view of a slide member.

FIGS. 8B through 8E show other embodiments of slide members for the compressor of the invention. FIG. 8A shows a plan view of the slide member 20 of the first embodiment (FIG. 1), which member has the groove 20*a* and the bores 20*b* provided on a bottom surface of the groove 20*a*, as described for the first embodiment. There are provided two bores 20*b* arranged along the vane 10*b*. The openings of the bores 20*b* correspond to the economizer ports EP1.

Figure 8B:
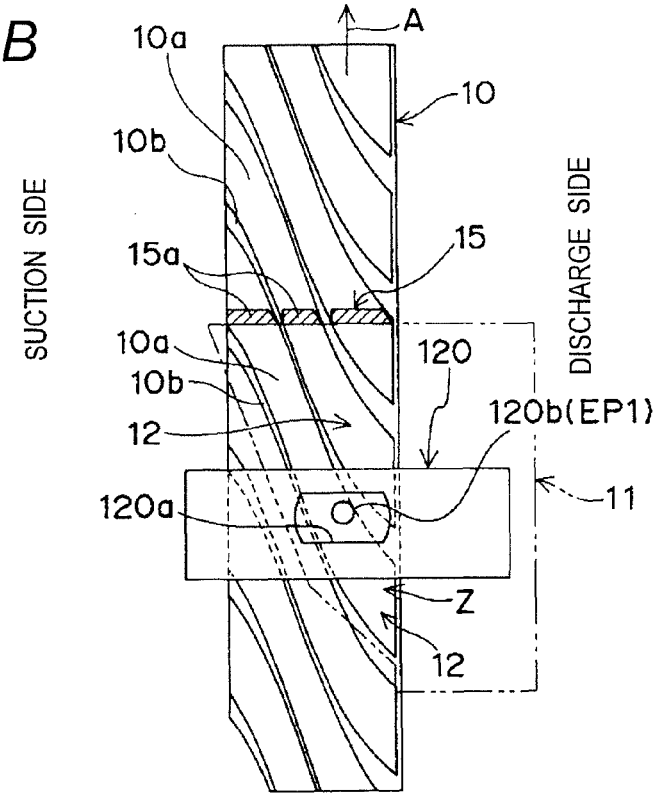
FIG. 8B is a plan view of another slide member.

A slide member 120 shown in FIG. 8B has a groove 120*a* and a bore 120*b* provided on a bottom surface of the groove 120*a*. There is provided one bore 120*b*, which has a circular shape. An opening of the bore 120*b* corresponds to the economizer port EP1.

Figure 8C:
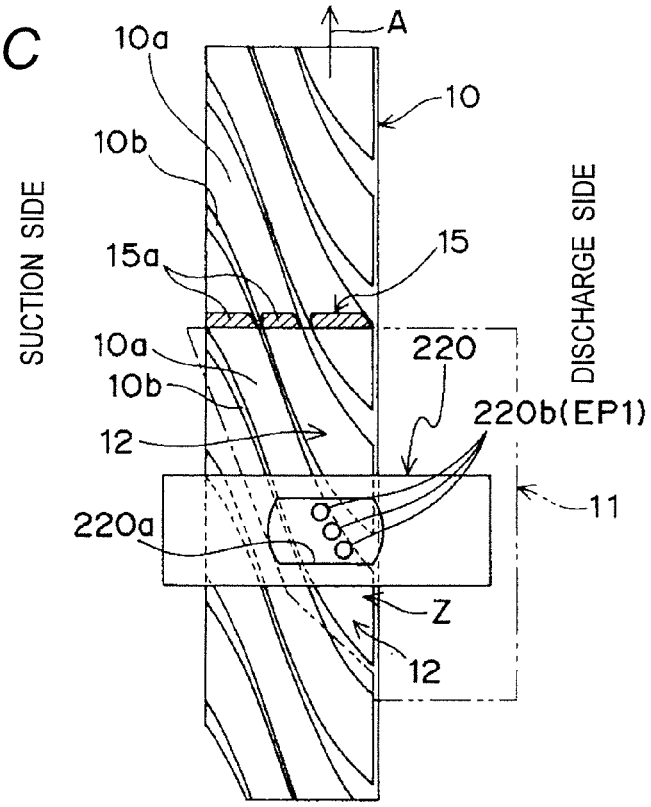
FIG. 8C is a plan view of another slide member.

A slide member 220 shown in FIG. 8C has a groove 220*a* and bores 220*b* provided on a bottom surface of the groove 220*a*. There are provided three bores 220*b*, which are arranged along the vane 10*b*. Openings of the bores 220*b* correspond to the economizer ports EP1.

Figure 8D:
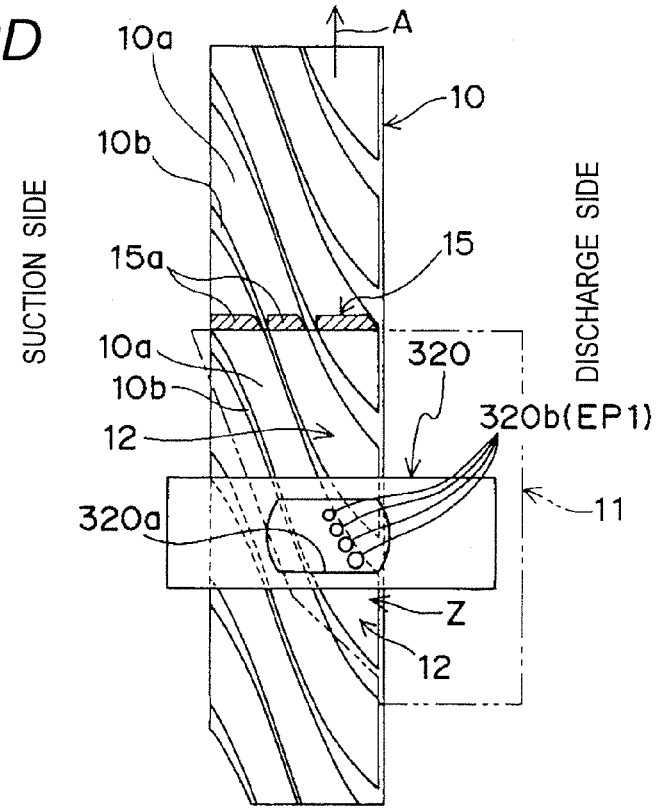
FIG. 8D is a plan view of another slide member.

A slide member 320 shown in FIG. 8D has a groove 320*a* and bores 320*b* provided on a bottom surface of the groove 320*a*. There are provided four bores 320*b*, which are arranged along the vane 10*b*. Openings of the bores 320*b* correspond to the economizer ports EP1. The nearer to the discharge side a bore 320*b* is, the larger diameter the bore 320*b* has. With such formation of the diameters of the bores 320*b* corresponding to widths of the vanes 10*b* increasing in a direction toward the discharge side, all the economizer ports EP1 can be opened and closed with the same timing so that efficiency can be improved.

Figure 8E:
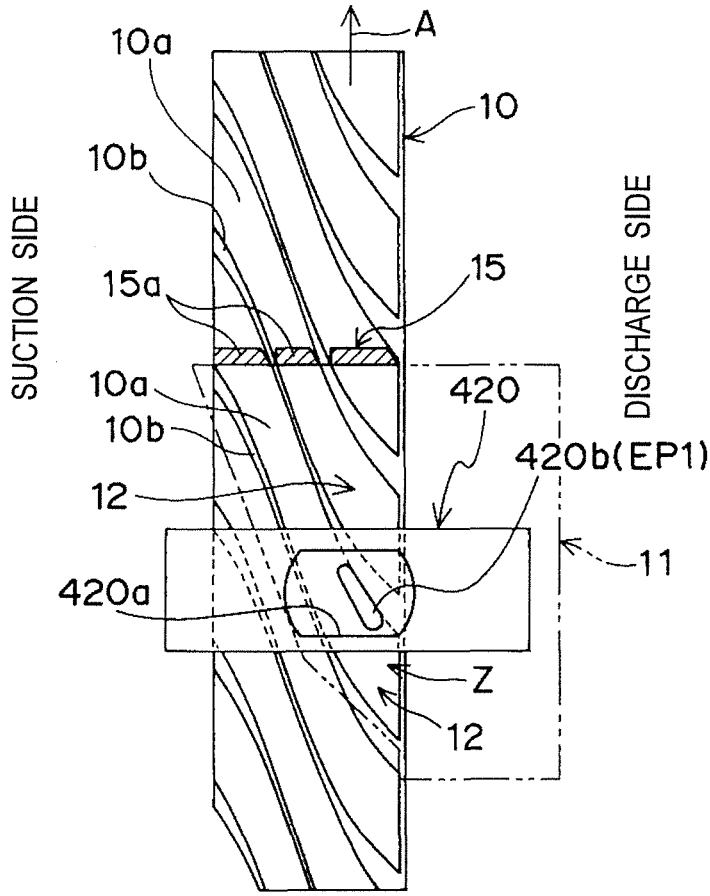
FIG. 8E is a plan view of another slide member.

A slide member 420 shown in FIG. 8E has a groove 420*a* and a bore 420*b* provided on a bottom surface of the groove 420*a*. There is provided one bore 420*b*, which is a slot extending along the vane 10*b*. An opening of the bore 420*b* corresponds to the economizer port EP1. Widths of the bore 420*b* increase in a direction toward the discharge side. With such formation of the widths of the bore 420*b* corresponding to widths of the vanes 10*b* increasing in the direction toward the discharge side, the economizer port EP1 can be opened and closed with the same timing across a length thereof so that efficiency can be improved.

The invention is not limited to the embodiments described above. For example, the compressor may be a so-called twin screw compressor. The number of the economizer ports can arbitrarily be increased or decreased. The economizer ports may be in shape of oval, ellipse or the like, other than circle. The second embodiment may be applied to the third embodiment.

What is claimed is:

1. A compressor comprising:

a casing;

a screw rotor fitted in the casing;

compression chambers formed between the screw rotor and the casing;

a slide member placed between the casing and the screw rotor, the slide member having at least one economizer port arranged to discharge refrigerant into the compression chambers, the slide member being movable along an axis of the screw rotor so that a position of the at least one economizer port is movable along the axis of the screw rotor; and a control unit controlling a position of the slide member along the axis of the screw rotor to control the position of the at least one economizer port along the axis of the screw rotor in accordance with rotating speed of the screw rotor in order to advance the timing of opening of the at least one economizer port to the compression chambers in accordance with the increase in the rotating speed of the screw rotor, the controller controlling the position of the slide member along the axis of the screw rotor such that the slide member moves upstream toward a suction side of the compressor when the rotating speed of the screw rotor increases, and the slide member moves downstream toward a discharge side of the compressor when the rotating speed of the screw rotor decreases.

2. A refrigerating apparatus comprising:

a screw compressor including a casing, a screw rotor fitted in the casing, compression chambers formed between the screw rotor and the casing, a slide member placed between the casing and the screw rotor, the slide member having at least one economizer port arranged to discharge refrigerant into the compression chambers, the slide member being movable along an axis of the screw rotor so that a position of the at least one economizer port is movable along the axis of the screw rotor, and a control unit controlling a position of the slide member along the axis of the screw rotor to control the position of the at least one economizer port along the axis of the screw rotor in accordance with the rotating speed of the screw rotor in order to advance the timing of opening of the at least one economizer port to the compression chambers in accordance with the increase in the rotating speed of the screw rotor, the controller controlling the position of the slide member along the axis of the screw rotor such that the slide member moves upstream toward a suction side of the compressor when the rotating speed of the screw rotor increases, and the slide member moves downstream toward a discharge side of the compressor when the rotating speed of the screw rotor decreases;

a condenser;

a heat exchanger;

an expansion unit; and an evaporator, the compressor, the condenser, the heat exchanger, the expansion unit, and the evaporator being sequentially connected to each other in a circulating circuit, and the heat exchanger and the at least one economizer port of the compressor being connected to each other by an economizer line.

* * * * *